US007942024B2

(12) United States Patent
Lee

(10) Patent No.: US 7,942,024 B2
(45) **Date of Patent: *May 17, 2011**

(54) WASHING MACHINE PROVIDED WITH SILVER SOLUTION SUPPLY DEVICE

(75) Inventor: Young Su Lee, Suwon-si (KR)

(73) Assignee: Samung Electronics Co., Ltd., Suwon-Si (KR)

( * ) Notice: Subject to any disclaimer, the term of this patent is extended or adjusted under 35 U.S.C. 154(b) by 735 days.

This patent is subject to a terminal disclaimer.

(21) Appl. No.: 10/582,136

(22) PCT Filed: Apr. 16, 2004

(86) PCT No.: PCT/KR2004/000875

§ 371 (c)(1),
(2), (4) Date: May 15, 2007

(87) PCT Pub. No.: WO2005/056908

PCT Pub. Date: Jun. 23, 2005

(65) Prior Publication Data

US 2007/0271967 A1 Nov. 29, 2007

(30) Foreign Application Priority Data

Dec. 9, 2003 (KR) ..... 10-2003-0089130

(51) Int. Cl.
*D06F 39/08* (2006.01)

(52) U.S. Cl. ..... 68/17 R

(58) Field of Classification Search ..... 68/17 R
See application file for complete search history.

(56) References Cited

U.S. PATENT DOCUMENTS

| | | | | |
|---|---|---|---|---|
| 4,755,268 | A * | 7/1988 | Matsuo et al. | 205/746 |
| 5,579,656 | A | 12/1996 | Shin | |
| 5,675,994 | A | 10/1997 | Gweon | |
| 6,743,351 | B1 * | 6/2004 | Arai et al. | 205/701 |
| 6,766,817 | B2 | 7/2004 | da Silva | |
| 6,918,404 | B2 | 7/2005 | Dias da Silva | |
| 7,066,586 | B2 | 6/2006 | Da Silva | |
| 2004/0025263 | A1 * | 2/2004 | Kim et al. | 8/159 |

(Continued)

FOREIGN PATENT DOCUMENTS

JP 3-215296 9/1991

(Continued)

OTHER PUBLICATIONS

Official translation of KR 2002-0012368.*

(Continued)

*Primary Examiner* — Joseph L Perrin
(74) *Attorney, Agent, or Firm* — Staas & Halsey LLP

(57) ABSTRACT

A washing machine comprising a tub, a water supply unit for supplying water to the tub and a silver solution supply device for supplying a silver solution to the tub, wherein the silver solution supply device includes a housing provided with an inlet and an outlet, a water feed unit for connecting the inlet of the housing and the water supply unit of the washing machine, two silver members installed in the housing and ionized by the electrolysis, and a current speed reduction member positioned between an end of the silver member located at the outlet and the outlet of the housing. The current speed reduction member reduces the current speed of the wash water supplied to the silver solution supply device and changes the current of the wash water, thereby allowing the silver members to be sufficiently ionized and providing sufficient antibiotic and bactericidal effects.

4 Claims, 3 Drawing Sheets

U.S. PATENT DOCUMENTS

| | | | | |
|---|---|---|---|---|
| 2004/0172985 | A1 * | 9/2004 | Mamiya et al. | 68/12.05 |
| 2004/0205899 | A1 * | 10/2004 | Park et al. | 8/159 |

FOREIGN PATENT DOCUMENTS

| | | | |
|---|---|---|---|
| JP | 5-84384 | | 4/1993 |
| JP | 2001-276484 | | 10/2001 |
| JP | 2003-991 | | 1/2003 |
| JP | 2003-290594 | | 10/2003 |
| KR | 20-0149366 | | 3/1999 |
| KR | 20020012368 | * | 2/2002 |
| KR | 20-0299230 | | 12/2002 |
| KR | 2003-0042505 | | 6/2003 |
| WO | WO02/081808 | | 10/2002 |
| WO | WO03057970 | * | 7/2003 |

OTHER PUBLICATIONS

U.S. Appl. No. 10/582,130, filed Jun. 8, 2006, Samsung Electronics Co., Ltd., Young Su Lee.

U.S. Appl. No. 10/582,160, filed Jun. 8, 2006, Samsung Electroncis Co., Ltd., Young Su Lee.

Restriction Requirement dated Nov. 19, 2009 for related U.S. Appl. No. 10/582,130.

Office Action dated Dec. 18, 2009 for related U.S. Appl. No. 10/582,160.

Chinese Office Action for Chinese Patent Application No. 2004-00363245 (correspond to U.S. Appl. No. 10/582,136) dated Sep. 19, 2008.

* cited by examiner

[Fig. 1]
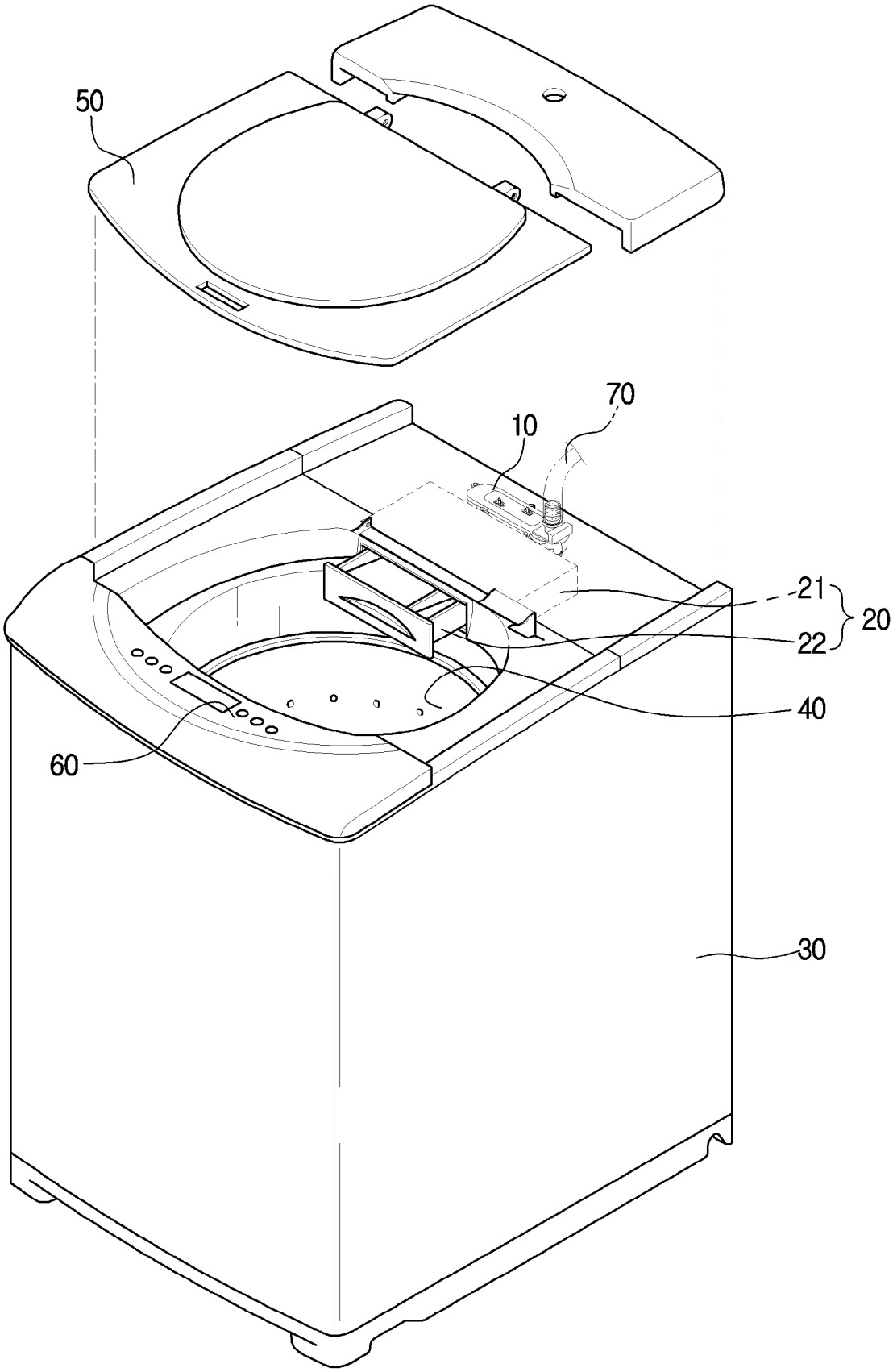

[Fig. 2]
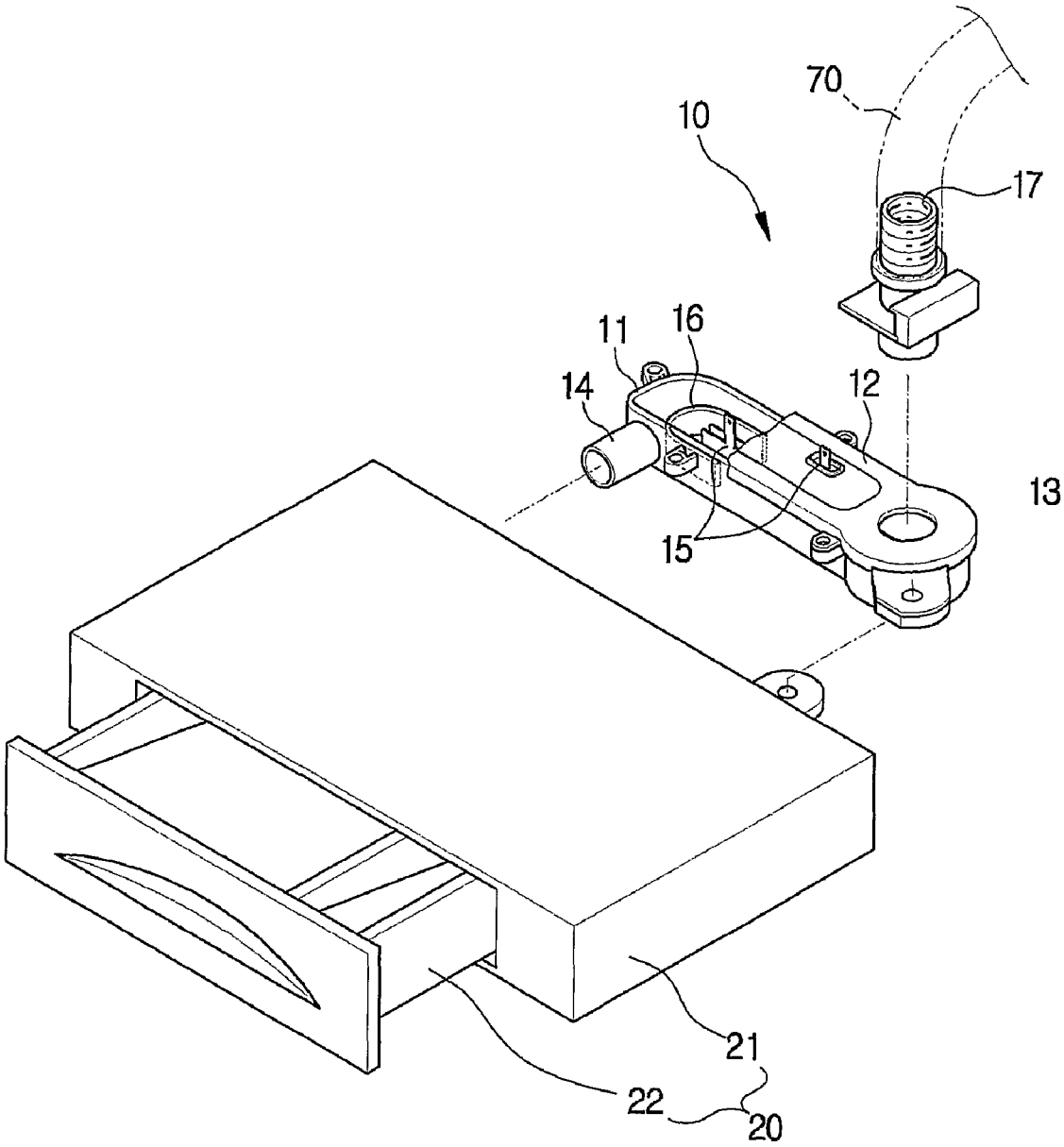

[Fig. 3]
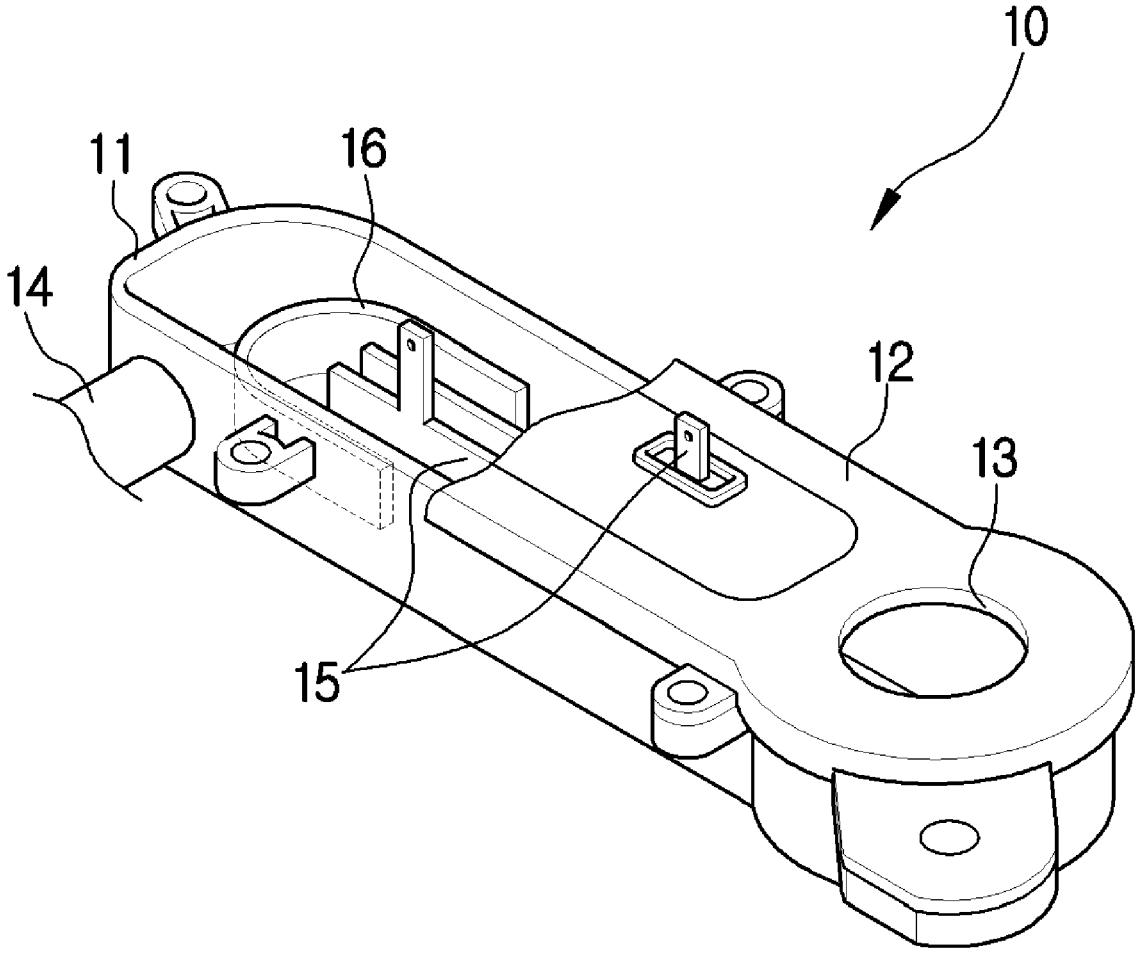

WASHING MACHINE PROVIDED WITH SILVER SOLUTION SUPPLY DEVICE

TECHNICAL FIELD

The present invention relates to a washing machine, and more particularly to a washing machine provided with a silver solution supply device so as to improve antibiotic and bactericidal effects.

BACKGROUND ART

Generally, a washing machine is an apparatus for washing laundry put into a tub by means of the friction generated by agitating the laundry together with wash water and a detergent using the driving force of a motor. A silver solution is a mixture of water and silver ions ($Ag^+$), and refers to a colloidal solution containing silver ions in a nano-particle state suspended in the water.

Silver (Ag) does not cause tolerance, differing from general antibiotics, and is nontoxic, thus being safe. Further, silver (Ag) even in a solid state has served as a natural antibiotic agent. However, large particles of silver may cause damage to the human body.

When silver (Ag) in the form of small particles is used, it has increased antibiotic and bactericidal effects. As the recent development of nano-techniques allows silver to be prepared in as a silver solution of a colloidal state, silver solution supply devices are installed in washing machines. The silver solution is made by electrolysis, chemical analysis, etc. The silver solution supply device of the washing machine generally employs electrolysis.

In a general washing machine using a silver solution, the silver solution is supplied to a tub and then a water current is generated, thereby performing a wash mode of the washing machine. Here, in order to maximize antibiotic and bactericidal effects, silver more than a designated concentration must be supplied. The silver solution supply device usually employs the current of the water supplied to the washing machine. In case that the current of the water has an excessively high speed, silver cannot be sufficiently ionized by the electrolysis and an insufficient concentration of silver ions deteriorates antibiotic and bactericidal effects.

DISCLOSURE OF INVENTION

Technical Problem

An object of the invention is to provide a height adjusting apparatus for expanding a height adjustment range of a household electric appliance, and the household electric appliance provided with the height adjusting apparatus.

Technical Solution

In accordance with one aspect, the present invention provides a washing machine comprising a tub, a water supply unit for supplying water to the tub and a silver solution supply device for supplying a silver solution to the tub, wherein the silver solution supply device includes a housing provided with an inlet and an outlet, a water feed unit for connecting the inlet of the housing and the water supply unit of the washing machine, two silver members installed in the housing and ionized by the electrolysis, and a current speed reduction member positioned between an end of the silver member located at the outlet and the outlet of the housing.

The current speed reduction member may be positioned on the bottom of the housing and have a U-shaped structure opened toward the silver members.

The current speed reduction member may have a height determined according to the size and shape of the housing so that the water floating into the inlet of the housing is retained near the silver members for a designated time and then flows toward the outlet of the housing.

The housing may have an opening through which the silver members are easily installed in the housing.

The washing machine may further comprise a detergent supply device, wherein the silver solution supply device is positioned above the detergent supply device, and the outlet of the housing of the silver solution supply device is connected to the inside of the detergent supply device.

In accordance with another aspect, the present invention provides a silver solution supply device comprising: a housing provided with an inlet and an outlet; a water feed unit connected to the housing; two silver members installed in the housing and ionized by the electrolysis; and a current speed reduction member positioned between an end of the silver member located at the outlet and the outlet of the housing.

The current speed reduction member may be positioned on the bottom of the housing and has a U-shaped structure opened toward the silver members.

The current speed reduction member may have a height determined according to the size and shape of the housing so that the water floating into the inlet of the housing is retained near the silver members for a designated time and then flows toward the outlet of the housing.

Advantageous Effects

As apparent from the above description, the present invention provides a silver solution supply device and a washing machine provided with the silver solution supply device, in which water is retained for a designated time in the silver solution supply device for performing the electrolysis of silver, thereby supplying sufficient silver ions to a tub and obtaining sufficient antibiotic and bactericidal effects.

Although the preferred embodiment of the invention has been disclosed for illustrative purposes, those skilled in the art will appreciate that various modifications, additions and substitutions are possible, without departing from the scope and spirit of the invention as disclosed in the accompanying claims.

DESCRIPTION OF DRAWINGS

1. The above objects, and other features and advantages of the present invention will become more apparent after reading the following detailed description when taken in conjunction with the drawings, in which:

FIG. 1 is a partially perspective view of a washing machine in accordance with the present invention;

FIG. 2 is a perspective view of a silver solution supply device and a detergent supply device of the washing machine in accordance with the present invention; and FIG. 3 is a perspective view of the silver solution supply device provided with a current speed reduction member of the washing machine in accordance with the present invention.

Best Mode

Now, a preferred embodiment of the present invention will be described in detail with reference to the annexed drawings.

FIG. 1 is a partially perspective view of a washing machine in accordance with the present invention. FIG. 2 is a perspective view of a silver solution supply device and a detergent supply device of the washing machine in accordance with the present invention.

The washing machine comprises a cabinet 30 for defining an appearance, a door 50 positioned at an upper end of the cabinet 30 for allowing laundry to be put into the cabinet 30, a tub (not shown) installed in the cabinet 30 for containing water, a drum 40 installed in the tub for containing the laundry and rotated, and a controller 60 for controlling a washing process.

Further, a detergent supply device 20 for supplying a detergent is provided near a water supply device, that is, on the upper end of the cabinet 30. In the washing machine in accordance with the preferred embodiment of the present invention, a silver solution supply device 10 connected to the water supply device 70 is provided near the detergent supply device 20.

In the preferred embodiment of the present invention, the silver solution supply device 10 is connected to the detergent supply device 20 positioned at the upper part of the washing machine, but the silver solution supply device 10 may be installed separately from the detergent supply device 20. However, the silver solution supply device 10 must be installed at a position, to which water can be supplied, such that a silver member 15 undergoes electrolysis by means of floating water and an obtained silver solution is put into the drum 40.

With reference to FIG. 2, the silver solution supply device 10 is connected to the water supply device 70 of the washing machine by a water supply unit 17, and an outlet 14 of the silver solution supply device 10 is connected to the inside of the detergent supply device 20. Further, a separate connection unit is installed such that it is connected to the detergent supply device 20 and an upper end of the cabinet 30 of the washing machine.

FIG. 3 is a perspective view of the silver solution supply device provided with a current speed reduction member of the washing machine in accordance with the present invention. Hereinafter, with reference to FIGS. 2 and 3, the silver solution supply device will be described in detail.

The silver solution supply device 10 of the washing machine of the present invention includes a housing 11 serving as a container for containing water for the electrolysis of the silver member 15. The housing 11 of the silver solution supply device 10 includes an inlet 13 for supplying the water introduced into the washing machine to the silver solution supply device 10 therethrough, and the outlet 14 formed on a lower part thereof for allowing silver ions generated by the electrolysis of the silver member 15 to pass through the detergent supply device 20 or to be directly introduced into the drum 40 therethrough.

Since the silver member 15, when it is worn out by means of the electrolysis, must be replaced with a new silver member 15, the housing includes an opening 12. In this case, the inlet 13 may be installed at the opening 12.

Two silver members 15 are positioned in the silver solution supply device 10. Each of the two silver members 15 has one protrusion protruded through the opening of the housing 10 to the outside. Positive and negative power sources are respectively connected to the protrusions of the two silver members 15 so that the electrolysis of the silver members 15 is achieved. The silver members 15 are positioned in the housing 11 so as not to prevent the flow of the water in the housing 11.

The washing machine provided with the silver solution supply device 10 in accordance with the present invention comprises a U-shaped current speed reduction member 16, having an opening toward the silver members 15, positioned between an end of the silver member 15 at the side of the outlet 14 and the outlet 14 of the housing 11.

The current speed reduction member 16 is formed on the bottom surface of the housing 15, and a height suitable to retain the water near the silver members 15 for a longer time and not to prevent the flow of the water so as to allow the water not to overflow through the housing 15 or a silver member exposure hole of the housing 15. That is, the height of the current speed reduction member 16 is similar to or lower than the height of the silver members 15.

Hereinafter, an operation of the washing machine provided with the silver solution supply device in accordance with the present invention will be described in detail.

When the housing 11 provided with the two silver members 15 installed therein is filled with water and positive and negative charges are respectively supplied to the two silver members 15, the silver members 15 of the silver solution supply device 10 are ionized, thereby generating silver ions.

Here, the silver members 15 are worn out by the ionization of silver, and are then replaced with new ones. It is known that silver ions have excellent antibiotic and bactericidal effects. However, when silver ions in the form of nano-particles are supplied at a designated density or more, they have sufficient antibiotic and bactericidal effects.

Accordingly, when water is supplied to the washing machine of the present invention through the water supply device 70 such as a water supply hose, the control of the controller 60 determines whether or not the silver solution is supplied. When it is determined that the silver solution is supplied, the silver solution supply device 10 is sufficiently filled with water and positive and negative currents are supplied to the exposed protrusions of the silver members 15 through the current supply unit (not shown) connected thereto. Thereby, the electrolysis of the silver member 15 is started.

Here, in order to uniformly consume the silver members 15, the positive and negative currents may alternately flow into the exposed protrusions of the silver members 15 by intervals of a designated time.

A colloidal solution, i.e., a silver solution, of silver ions generated from the electrolysis of the silver members 15 is introduced into the detergent supply device 20, and is then supplied to the drum 40 through an outlet of the detergent supply device 20. This step is selectively achieved according to the control of the controller 60, thereby allowing the laundry to be sterilized by means of the silver ions.

When the silver solution supply device 10 is filled with water supplied from the water supply device 70 through the inlet 13 of the housing 11 and has a sufficient water level for the electrolysis of the silver members 15, current flows through the protrusions of the silver members 15 exposed to the outside of the housing 11 connected to the power source, thereby allowing the silver members 15 to be consumed and generating a silver solution including silver ions mixed with water.

At this time, since the speed of the flow of the water supplied to the water supply device 70 of the conventional washing machine is high, the water cannot be retained in the silver solution supply device 10 for a sufficient time for the electrolysis of the silver members 15, thus causing a difficulty in obtaining a sufficient density of the silver ions required to obtain antibiotic and bactericidal effects.

Hereinafter, an operation of the current speed reduction member of the present invention for solving the above conventional problem will be described in detail. Water is introduced into the silver solution supply device 10 through the water supply device 70 of the washing machine, and flows near the silver members 15.

The water is retained near the current speed reduction member 16, and then passes through the current speed reduction member 16 having a comparatively low height and flows into the detergent supply device 20 through the outlet 14 of the silver solution supply device 10 by the volume and pressure of the water continuously supplied through the inlet 13 of the silver solution supply device 10. Thereby, the silver solution is supplied to the drum 40 through the outlet of the detergent supply device 20.

Here, since the speed of the flow of the water is reduced and the flow of the water is partially changed by the current speed reduction member 16 positioned between the end of the silver member 15 located at the outlet 14 of the housing 11 and the outlet 14 of the housing 11, the water can be retained in the housing 11 for a time required for the electrolysis of the silver members 15.

Thereby, the silver ions ($Ag^+$) obtained by the electrolysis exist on the surfaces of the silver members 15, and are mixed with the water, thereby effectively forming a silver solution. Accordingly, it is possible to supply the silver solution containing the silver ions sufficient to obtain antibiotic and bactericidal effects to the drum 40.

As apparent from the above description, the present invention provides a silver solution supply device and a washing machine provided with the silver solution supply device, in which water is retained for a designated time in the silver solution supply device for performing the electrolysis of silver, thereby supplying sufficient silver ions to a tub and obtaining sufficient antibiotic and bactericidal effects.

Although the preferred embodiment of the invention has been disclosed for illustrative purposes, those skilled in the art will appreciate that various modifications, additions and substitutions are possible, without departing from the scope and spirit of the invention as disclosed in the accompanying claims.

The invention claimed is:

1. A washing machine comprising:

a tub;

a water supply unit to supply water to the tub;

a silver solution supply device to supply a silver solution to the tub; and a detergent supply device connected with the silver solution supply device to directly supply water containing the silver solution generated from the silver solution device to the tub, wherein the silver solution supply device includes a housing provided with an inlet and an outlet, a water feed unit to connect the inlet of the housing and the water supply unit of the washing machine, two silver members installed in the housing and ionized by the electrolysis, and a water flow speed reduction member positioned between an end of the silver member located at the outlet of the housing, which is connected to the detergent supply device, and the outlet of the housing, the water flow speed reduction member being positioned inside and on the bottom of the housing and having a fixed U-shaped structure opened toward the silver members.

2. The washing machine according to claim 1, wherein the water flow speed reduction member has a height determined according to the size and shape of the housing so that the water flowing into the inlet of the housing is retained near the silver members for a designated time and then flows toward the outlet of the housing.

3. The washing machine according to claim 1, wherein the housing has an opening through which the silver members are easily installed in the housing.

4. The washing machine according to claim 1, wherein the silver solution supply device is positioned above the detergent supply device, and the outlet of the housing of the silver solution supply device is connected to the inside of the detergent supply device.

* * * * *

UNITED STATES PATENT AND TRADEMARK OFFICE

CERTIFICATE OF CORRECTION

PATENT NO. : 7,942,024 B2
APPLICATION NO. : 10/582136
DATED : May 17, 2011
INVENTOR(S) : Young Su Lee It is certified that error appears in the above-identified patent and that said Letters Patent is hereby corrected as shown below:

On the Title page Item (73) (Assignee), Delete "Samung" and insert -- Samsung --, therefor.

Signed and Sealed this
Twenty-first Day of February, 2012

David J. Kappos

David J. Kappos
*Director of the United States Patent and Trademark Office*